United States Patent [19]

Beam et al.

[11] Patent Number: 4,774,817

[45] Date of Patent: Oct. 4, 1988

[54] NON-HYGROSCOPIC, NON-ALLERGENIC EARRING CONSTRUCTION

[75] Inventors: June A. Beam, 5023 Sage Rd.; Beverly J. Miller, 18750 W. 5th Rd., both of Plymouth, Ind. 46563

[73] Assignees: June Anne Beam; Beverly Jo Miller, both of Plymouth, Ind.

[21] Appl. No.: 768,410

[22] Filed: Aug. 22, 1985

[51] Int. Cl.[4] ..... A44C 7/00

[52] U.S. Cl. ..... 63/12; 40/301; 128/330

[58] Field of Search ..... 63/12, 13; 128/329 R, 128/329 A, 330; 119/135, 156; 40/302, 301

[56] References Cited

U.S. PATENT DOCUMENTS

| | | | |
|---|---|---|---|
| 3,663,965 | 7/1972 | Lee | 623/11 |
| 3,910,065 | 10/1975 | Holt | 63/12 |
| 3,945,089 | 3/1976 | Gagnon . | |
| 4,067,341 | 1/1978 | Ivey | 63/13 X |
| 4,089,189 | 5/1978 | Verducci . | |
| 4,353,370 | 10/1982 | Evans . | |
| 4,593,540 | 6/1986 | Cuvar et al. | 63/12 |
| 4,696,119 | 9/1987 | Howe | 40/301 |

FOREIGN PATENT DOCUMENTS

| | | | |
|---|---|---|---|
| 837328 | 4/1952 | Fed. Rep. of Germany . | |
| 609457 | 9/1948 | United Kingdom . | |
| 1117966 | 6/1968 | United Kingdom | 63/12 |

OTHER PUBLICATIONS

Polymer Handbook Published by John Wiley & Sons, New York 1975 pp. VIII-5 and VIII-6.

*Primary Examiner*—Richard J. Johnson
*Attorney, Agent, or Firm*—Barnes & Thornburg

[57] ABSTRACT

An earring is provided having an integrally molded post and ornament base formed from non-hygroscopic, non-allergenic plastic materials. The backing member is similarly formed and frictionally engages the post to retain the earring within the earlobe. The post is seamlessly molded, and ornaments are secured to the ornament base by epoxy. The ornament base is sufficiently enlarged so as to prevent skin contact with the ornament in embodiments where the ornament is not integrally molded with the post and base. In preferred embodiments, the base and posts are injection molded from polypropylene material and the backing member is formed from thermoplastic rubber.

13 Claims, 2 Drawing Sheets

NON-HYGROSCOPIC, NON-ALLERGENIC EARRING CONSTRUCTION

BACKGROUND AND SUMMARY OF THE INVENTION

The present invention relates generally to non-metallic earring construction and, more particularly to earrings formed from molded plastic and suitable for use in pierced ears.

Numerous people have experienced difficulty and discomfort in wearing earrings suspended from pierced ear openings through the earlobes. One source of problems with such "pierced" earrings has resulted from the sensitivity some people have toward materials that come in contact with the exterior skin surface and/or the tissue within the pierced openings. For example, certain people have an allergic reaction to contact with metals, particularly nickel alloys. In some cases metals are actually absorbed through the skin or ear tissue and result in infection and/or illness. Plastic materials used in earrings have also been a source of irritation and discomfort due to their relatively coarse surface textures and molding seams and/or tissue permeability.

Bacterial infections within the earlobe opening are another commonly experienced problem. Perspiration and environmental moisture can carry surface bacteria, dirt, and microscopic debris to the earlobe opening. Where hygroscopic materials are used at the portion of the earring that penetrates that opening, the moisture-borne bacteria and debris can actually be transported to the interior of the earlobe. Especially when the ear tissue has been recently pierced, this can cause painful infections which persist even after the earring is removed. In addition, infections can also result within the earlobe opening directly from metabolic reactions with respect to the earring material.

Further, irritating discomfort has sometimes been caused by the earring construction itself. Optimally, the portion of the earring penetrating the earlobe should be as small as possible so as to minimize tissue exposure and supporting compression about the opening, especially immediately after the ear is pierced. It is also important that sharp edges, which could cut or scrape the skin surface, be avoided in both the earring support structure and the attached ornament.

These concerns have been long felt, and numerous unsuccessful attempts have been made to provide a universally acceptable earring. For example, it has been suggested to plate the "post" portion of the earring penetrating the earlobe with generally non-allergenic material, such as gold. However, not only does such plating commonly wear-off, gold is rarely plated in its pure form because of its relative softness. Gold-nickel alloys are commonly used, but even that nickel can be the source of an allergic reaction.

Posts formed from pure gold are often prohibitively expensive and not strong enough to properly support the ornament unless considerably thickened. Again, however, such posts are often uncomfortable because of the extra tissue compression they require within the ear opening. Further, a significant number of people suffer an allergic response to tissue contact with any metallic substance.

Even where the post construction is comfortable, earrings can cause irritation of the exterior skin surface for the same and for different reasons. Materials sensitivity can require that even the ornament base attached to the post be formed from a non-allergenic material. This can significantly increase the earring cost and make it difficult to attach an ornament to that base. Also, where skin contact with the ornament material would cause discomfort, the base must be large enough and carefully configured to prevent such contact.

Shields and sleeves of non-allergenic materials have been proposed which slide over the post and/or the base of otherwise unusable materials. While these have been satisfactory solutions for some people, others have found that base shields do not completely prevent moisture borne migration from the underlying metals to the skin or ear tissue. Also, sleeves are by necessity larger than the underlying post and can cause uncomfortable tissue compression within the earlobe opening. Further, sleeves are typically marketed such that they are cut to fit and mounted by the user and thereby require considerable care to avoid leaving sharp edges to scrape or cut the skin. On the other hand, shields and sleeves that are permanently mounted to the earring by the manufacturer are significantly more expensive.

Various plastic materials have been suggested for use in earrings. However, plastics are often difficult to mold into thin, rod-like components without a considerable loss of strength and rigidity. Thus, as compared with metal posts, plastic posts are often considerably thicker and thereby cause uncomfortable compression of the earlobe opening tissue. Also, in some molding processes a surface seam remains on the finished product which can cause skin irritation. Further, it can be more difficult to secure some metal ornaments to a plastic base and many plastic pigments are toxic with prolonged tissue contact.

Plastic materials themselves can also be absorbed through the skin to cause inflammation and infection. While many non-hygroscopic plastic materials are known, not all of these are non-allergenic, inexpensive and readily molded into thin and complex parts.

Finally, it has been suggested that infection and irritation can be avoided by gradually conditioning the skin and ear tissue. For example, after initial piercing, earrings have very thin posts and coated with medication would be used. After a while, larger earring posts and unmedicated earrings would be substituted. However, this approach can be relatively expensive since a duplicity of earrings must be acquired, some of which are specially formed and medicated. Also, success is not ensured; allergic reactions and infection can occur when the medication ceases.

Accordingly, it is an object of the present invention to provide a universally acceptable pierced earring construction.

Another object is the provision of an earring formed from non-hygroscopic and non-allergenic materials.

A further object is to provide an inexpensive, injection molded plastic earring that can be comfortably and safely worn immediately after the ear is initially pierced.

Still another object is the provision of an earring formed from materials which are chemically inert with respect to body tissues and fluids.

These and other objects of the present invention are attained by the provision of an earring having an integrally molded post and ornament base formed from non-hygroscopic, non-allergenic plastic materials. The backing member is similarly formed and frictionally engages the post to retain the earring within the earlobe.

The post is seamlessly molded, and ornaments are integrally molded therewith or secured to the ornament base by epoxy. The ornament base is sufficiently enlarged so as to prevent skin contact with the ornament. In preferred embodiments, the base and post are injection molded from polypropylene material and the backing member is formed from thermoplastic rubber.

Other objects, advantages and novel features of the present invention will become readily apparent from consideration of the following detailed description of the invention when considered in conjunction with the accompanying drawings.

DETAILED DESCRIPTION OF THE INVENTION

Figure 1:
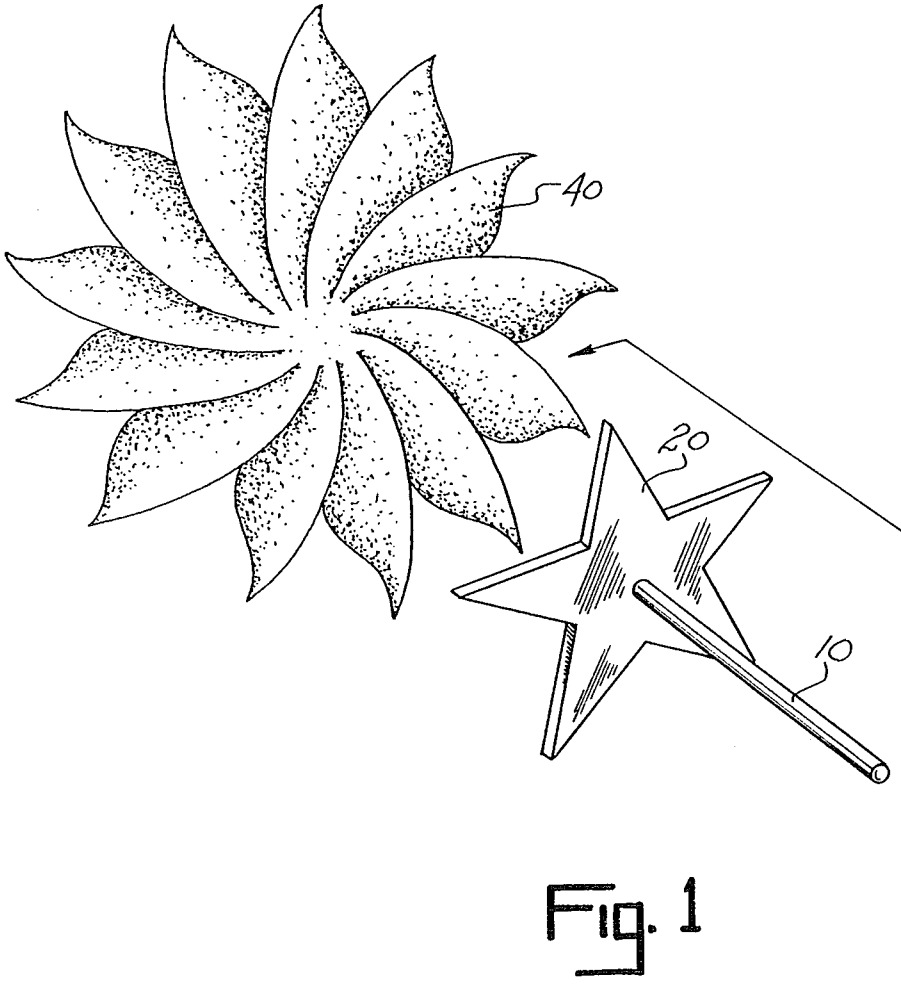
FIG. 1 is an exploded perspective view of an earring construction according to the present invention.

FIG. 1, which illustrates a preferred embodiment of the present invention, shows an earring having post member 10, base portion 20, backing member 30 and ornament 40. This earring is suitable for use with "pierced" ears wherein post 10 is mounted within an opening in the earlobe to support the earring during wear. Backing 30 includes channel 35 therein which is dimensioned so as to receive a portion of post 10 extending through the earlobe and thereby prevent inadvertent dislodging of the earring from the earlobe.

Figure 2:
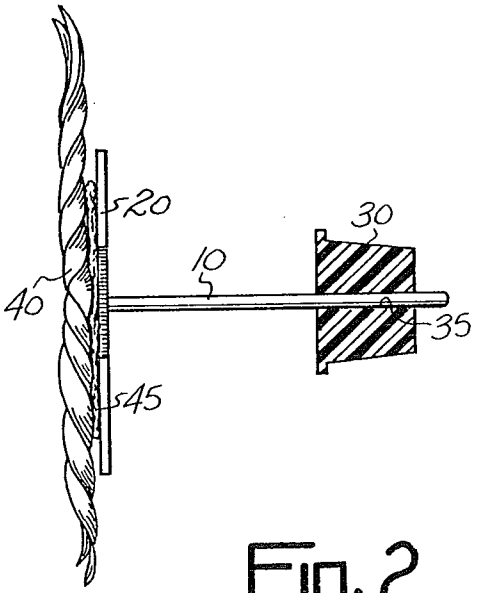
FIG. 2 is a side plan view of the earring construction of FIG. 2.
Figure 4:
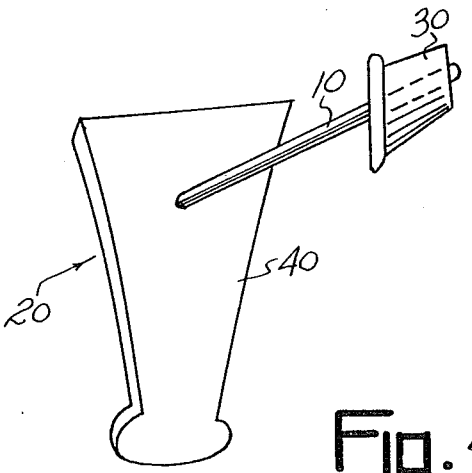
FIG. 4 is a perspective view of an embodiment of the present invention where the ornament is integrally molded with and of the same material as the post and base.

Base 20 is integrally molded with post 10. Ornament 40 is, for example, secured to the side of base 20 opposite post 10 by adhesive 45, as shown in FIG. 2. Alternatively, ornament 40 is integrally molded with base 20 and post 10, as shown in FIG. 4. Where ornament 40 is not formed from a non-allegenic, non-hygroscopic material, base 20 is dimensioned in width and thickness so as to prevent contact between portions of ornament 40 or adhesive 45 and the earlobe skin surface of the wearer. In the illustrated embodiment, base 20 is formed as a five-point star, although it will now be understood by those skilled in the art that other configurations are contemplated by the present invention.

Post 10 is preferably dimensioned so as to be as thin as possible, yet still sufficiently rigid to support the earring without significant bending inside the earlobe opening. Excess bending would be a source of discomfort to the user. Post 10 has a smooth surface texture and is, for example, seamlessly molded. Channel 35 is dimensioned so as to cooperatively receive and frictionally engage post 10 to prevent backing 30 from sliding off.

Ornament 40 can be formed from any suitable material, including, for example, gems, metal, plastic, ceramic, or cloth. On the other hand, base 20 and post 10 are formed from non-hygroscopic, non-allergenic materials, preferably those also medically approved for in-body use. One such commercially available material is "PRO-FAX", type PD621, polypropylene, as sold by Himont U.S.A., Inc. of Wilmington, Del. In the present invention, this homopolymer resin is injection molded into the earring base and post. Subsequent radiological sterilizing of these molded components assists in reducing the risk of infection but does not cause discoloration. "PRO-FAX" polypropylene has previously been used for making medical devices, sutures and implant joints.

Backing member 30 is not subject to the same stresses and rigidity requirements as the base and post portions of the earring. However, it has been found to be particularly advantageous to also mold backing 30 from non-hygroscopic, non-allergenic materials since skin surface contact commonly occurs. One such commercially available material suitable for use in backing 30 is "SANTOPRENE", type 271-64, thermo-plastic rubber, as sold by Monsanto Polymer Products Company of St. Louis, MO.

Adhesive 45 is employed to secure the diverse materials of ornament 40 to the material of base 10. Where base 10 is formed from "PRO-FAX" polypropylene, adhesive 45 is, for example, "THERMOLOK", type 5010, hot melt adhesive, or "PRECISION", type 6091, contact adhesive, or "CHEMLOK", type 305, epoxy, each as sold by Hercules, Inc. of Wilmington, Del.

Where ornament 40 is integrally molded with base 20 and post 20, the ornament pigment is also a non-toxic material. Any desired ornament configuration can be so molded as a one-piece earring without the use of metals. "PRO-FAX", type PD 621, polybutylene has also been found to provide an acceptable ornament finish in terms of gloss and durability.

Figure 3:
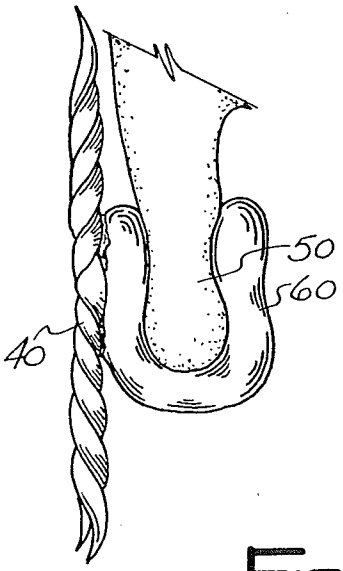
FIG. 3 is a side plan view of a clip-on embodiment of the present invention with the earlobe shown in cross-section.

Earrings provided by the present invention can be comfortably worn by virtually everyone, even immediately after the ears are initially pierced, without fear of irritation or infection. Injection molding of the unitary base and post with non-hygroscopic, non-allergenic material also provides a cost-effective production technique without sacrificing ornament versatility. Also, the particular materials used produce an extremely durable and virtually unbreakable earring construction. Further, the present invention contemplates various other embodiments also having these advantages. For example, base 20 itself can be molded as an ornament. Also, clip-on earrings can be molded from these same non-hygroscopic, non-allergenic plastics such that skin surface 50 only contacts those earring surfaces 60 formed from such plastics, as shown generally in FIG. 3. Likewise, various other articles of jewelry, such as rings and bracelets, can also be formed from such non-allergenic, non-hygroscopic materials wherever metabolic tissue reaction and infection are a concern.

From the preceding description of the preferred embodiments, it is evident that the objects of the present invention are attained. Although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. An earring construction, for attachment to the wearer's earlobe, comprising:

an ornament;

a post means for penetrating said earlobe;

a base means, integrally formed with said post means, for supporting said ornament;

a backing means for securing said post means in generally fixed relation to said earlobe; and said integrally formed base and post means being molded from non-hygroscopic, non-allergenic non-metallic material.

2. The earring construction of claim 1 wherein said base means is dimensioned and oriented with respect to said ornament so as to prevent contact between said ornament and said earlobe.

3. The earring construction of claim 2 wherein said post means is formed with a smooth, seamless surface texture.

4. The earring construction of claim 1 wherein said ornament is integrally molded with respect to said base means and said post means.

5. The earring construction of claim 3 wherein said molded plastic is "PRO-FAX", type PD 621 polypropylene.

6. The earring construction of claim 4 wherein said backing means is molded from a thermoplastic rubber.

7. A one-piece construction for an article of jewelry in tissue contact with the wearer, comprising an arrangement where the tissue engaging surfaces of said jewelry are formed from polypropylene homopolymer resin, non-allergenic, non-metallic materials.

8. In an earring construction for attachment to an earlobe, comprising:

an ornament portion, a base portion to which said ornament portion is connected, a post portion connected to said base portion for penetrating said earlobe, and a backing element engageable with said post portion for securing said post portion within said earlobe, the improvement comprising said post portion being formed from polypropylene homopolymer resin, non-metallic materials.

9. The earring construction according to claim 8 wherein said improvement further includes said post and base portion are integrally formed from polypropylene homopolymer resin, non-metallic materials.

10. The earring construction according to claim 9 wherein said base portion and said post are disposed such that said earlobe is not normally in contact with said ornament.

11. The earring construction according to claim 8 wherein said improvement further includes said backing element being formed from non-hygroscopic, non-metallic materials.

12. The earring construction according to claim 8 wherein said improvement further includes said base portion and said backing element being disposed with respect to said post and said earlobe and being formed such that said earlobe normally contacts only non-hygroscopic, non-metallic materials adjacent the penetration of said earlobe by said post portion.

13. The earring construction according to claim 8 wherein said post portion is sufficiently rigid to support said ornament portion substantially without bending inside said earlobe.

* * * * *

UNITED STATES PATENT AND TRADEMARK OFFICE

CERTIFICATE OF CORRECTION

PATENT NO. : 4,774,817

DATED : October 4, 1988

INVENTOR(S) : June A. Beem and Beverly J. Miller

It is certified that error appears in the above-identified patent and that said Letters Patent is hereby corrected as shown below:

On the title page

In Section [73] please delete "Beam" and insert --Beem--.

In Section [75] please delete "Beam and insert --Beem--.

Signed and Sealed this

Fourteenth Day of March, 1989

*Attest:*

*Attesting Officer*

DONALD J. QUIGG

*Commissioner of Patents and Trademarks*